United States Patent [19]

Pawlenko

[11] Patent Number: 4,999,907

[45] Date of Patent: Mar. 19, 1991

[54] DATA CONNECTOR ATTACHMENT TOOL

[75] Inventor: Ivan Pawlenko, Holland, Pa.

[73] Assignee: AT&T Bell Laboratories, Murray Hill, N.J.

[21] Appl. No.: 555,958

[22] Filed: Jul. 23, 1990

[51] Int. Cl.[5] ..... b23P 21/00

[52] U.S. Cl. ..... 29/721; 29/753; 29/759

[58] Field of Search ..... 29/721, 748, 749, 751, 29/753, 759, 857, 861

[56] References Cited

U.S. PATENT DOCUMENTS

| | | | |
|---|---|---|---|
| 3,995,358 | 12/1976 | Long et al. | 29/203 MW |
| 4,006,519 | 2/1977 | Long et al. | 29/749 |
| 4,014,087 | 3/1977 | Cover et al. | 29/721 |
| 4,034,472 | 7/1977 | Cover et al. | 29/749 |
| 4,403,406 | 9/1983 | Foley | 29/721 |
| 4,517,718 | 5/1985 | Johnston, Jr. | 29/33 M |
| 4,878,295 | 11/1989 | Muhlberger | 29/749 |
| 4,903,399 | 2/1990 | Billingham et al. | 29/753 |

*Primary Examiner*—P. W. Echols
*Attorney, Agent, or Firm*—R. B. Levy

[57] ABSTRACT

Attachment of each of a pair of wires (12) in a cable (14) to each of a pair of opposed contacts (16) in a connector (20) is carried out by a connector attachment tool (10) which includes a cable clamp assembly (34) for clamping the cable in either a horizontal or vertical orientation. The clamp assembly holds the cable so that an operator can pull each of a pair of the wires along a separate one of a pair of wire guides (96,98) which each include retention springs (106,108,110) for grabbing the pulled wire. Each wire guide serves to align the wire pulled therealong with a separate one of a pair of opposed ram assemblies (86,88) located on opposite sides of a carriage (30) which carries the connector. Each ram assembly serves to force the wire aligned therewith into one of the opposed connector contacts aligned with the ram assembly. A mechanism (112) is provided for advancing the carriage once each of a pair of wires has been attached to each of a pair of opposed contacts so as to bring each of a successive pair of connector contacts into alignment with a separate one of the ram assemblies. Each of a pair of scales (116,118) lies on opposite sides of the carriage for indicating which of the connector contacts is opposite a separate one of the ram assemblies.

13 Claims, 5 Drawing Sheets

DATA CONNECTOR ATTACHMENT TOOL

TECHNICAL FIELD

This invention relates to an apparatus for attaching successive pairs of wires in a cable to successive pairs of opposed contacts in a data connector.

BACKGROUND OF THE INVENTION

Although optical fiber is quickly supplanting conventional copper cable as the media of choice for carrying data, multi-conductor copper cables are still used, particularly for short-haul data transmission between various pieces of data communications equipment. A typical multi-conductor cable for interconnecting two pieces of data communications equipment usually has each of its ends terminated with a data connector, the most popular of which is the RS-232 type connector. This type of connector is comprised of an insulative (e.g., plastic) block containing two rows of opposed recesses, each recess seating a corresponding contact. An electrical connection between each contact and a corresponding wire in the cable is usually obtained by physically ramming the wire into the connector recess so as to be pierced by a barb on the contact. When the connector barb has pierced the insulation on the wire, an electrical contact will be established between the contact and the wire. Once all of the connections have been made in this manner, a hood is placed over the block to shield the contacts.

Attachment of an RS-232 type data connector to each end of a cable may occur either in a factory where the cable is made, or at a field site where the cable is to be installed. In the factory, the volume of connectors to be installed is usually such that an automated connector attachment machine can be employed. An example of such an attachment machine is disclosed in U.S. Pat. No. 4,014,087 and 4,034,472, issued in March 1977 and June 1977, respectively, to W. Cover et al.

However, in the field, the volume of connectors to be installed is usually too low to economically justify the use of a fully automated connector attachment machine because such machines are usually very expensive. Even if the volume were indeed high enough to economically justify such a machine, conditions in the field are often such that fully automated connector attachment machines, which are typically very bulky and complex, cannot be readily deployed. Rather, field installation of data connectors is generally accomplished by hand, typically with the aid of a specially designed pliers which serves to ram each individual wire into a connector recess so as to be pierced by the contact. As may be appreciated, manual installation of data connectors in this manner is tedious and expensive.

U.S. Pat. No. 4,903,399, issued on Feb. 27, 1990, in the names of K. H. Billingham et al., and assigned to AT&T (herein incorporated by reference), discloses a tool useful in the field for attaching successive pairs of wires in a cable to successive pairs of opposed contacts on a connector, such as a "ribbon"-type connector used within the telecommunications industry. The Billingham et al. tool comprises a base that mounts a track along which a connector-carrying carriage is slidably disposed. The carriage serves to carry the connector, with its recesses vertically oriented, past a pair of wire guides on opposed sides of the track. Each wire guide serves to guide a wire pulled thereacross by an operator into alignment with each of a pair of ram assemblies, each located adjacent to a corresponding wire guide. Each ram assembly serves to ram the wire aligned therewith into a connector recess opposite the ram to attach the wire to the contact seated in this recess. After each of a pair of wires is attached to a separate one of the pair of opposed contacts aligned with each ram assembly, the carriage is automatically advanced to bring each of another pair of contacts into alignment with a separate one of the ram assemblies.

While the Billingham et al. tool has proven very useful for field installation of ribbon-type connectors, attachment of RS-232 type connectors with this tool has proven somewhat inconvenient. With some types of RS-232 connectors, the connector hood is adapted to clamp the cable so that the axis of the cable is at a right angle to the longitudinal axis of the recesses in the connector block. This type of connector is known as a "right-angle" connector. With other types of RS-232 connectors, the hood clamps the cable so that the cable has its longitudinal axis generally parallel to the longitudinal axis of the recesses in the connector block. This type of connector is often referred to as a "straight" type RS-232 connector. As presently designed, the Billingham et al. tool clamp the cable horizontally so the wires within the cable are perpendicular to the recesses in the connector block. Clamping the cable so that the wires are at a right angle to the connector recesses greatly facilitates the assembly of the right-angle type RS-232 connector. However, the fact that the Billingham et al. tool clamps the wire horizontally makes it difficult to employ this tool to attach "straight" type RS-232 connectors.

Another drawback of the Billingham et al. connector attachment tool is that the operator must continually pull and hold each of a successive pair of wires into alignment with a separate one of the ram assemblies as the ram assembly forces the wire against the contact. The need to continuously tension the wires during connector attachment can be tiresome, leading to operator fatigue. Further, there is currently no mechanism associated with the present day Billingham et al. tool to readily identify which pair of contacts is currently being attached to a pair of wires.

Thus, there is need for an improved tool for attaching successive pairs of wires in a cable to successive pairs of opposed contacts on a data connector which is not subject to the foregoing disadvantages.

SUMMARY OF THE INVENTION

Briefly, in accordance with a preferred embodiment of the invention, there is provided an apparatus for attaching each of a successive pair of wires in a cable to a separate one of a pair of opposed contacts in a data connector. The apparatus comprises a base rising up from which is a wall that runs along a first axis. A carriage for carrying the connector is slidably mounted to the wall for movement along the first axis. A cable clamp assembly is adapted for detachable mounting to the wall in each of two separate positions to releasably clamp the cable in a vertical and a horizontal orientation, respectively. A pair of ram assemblies is mounted to the base, each on opposed sides of the wall, for ramming a separate one of a pair of wires against a separate one of a pair of opposed contacts in the connector. A separate one of a pair of scales may be mounted to each of the opposed sides of the wall adjacent to a separate one of the ram assemblies to identify the particular contact now aligned with a corresponding ram assembly. Each of a pair of wire guides is located adjacent to a separate one of the rams for guiding a wire, pulled along the guide by an operator, into alignment with the corresponding ram assembly so that the wire can be rammed by the ram assembly against the contact. Associated with each wire guide is a wire retainer which serves to releasably hold the wire pulled along the wire guide in alignment with the ram. Finally, a mechanism is provided for successively displacing the carriage along the first axis so that each of a successive pair of connector contacts may be aligned with each corresponding ram assembly once a previous pair of contacts has been attached to a corresponding pair of wires.

DETAILED DESCRIPTION

Figure 1:
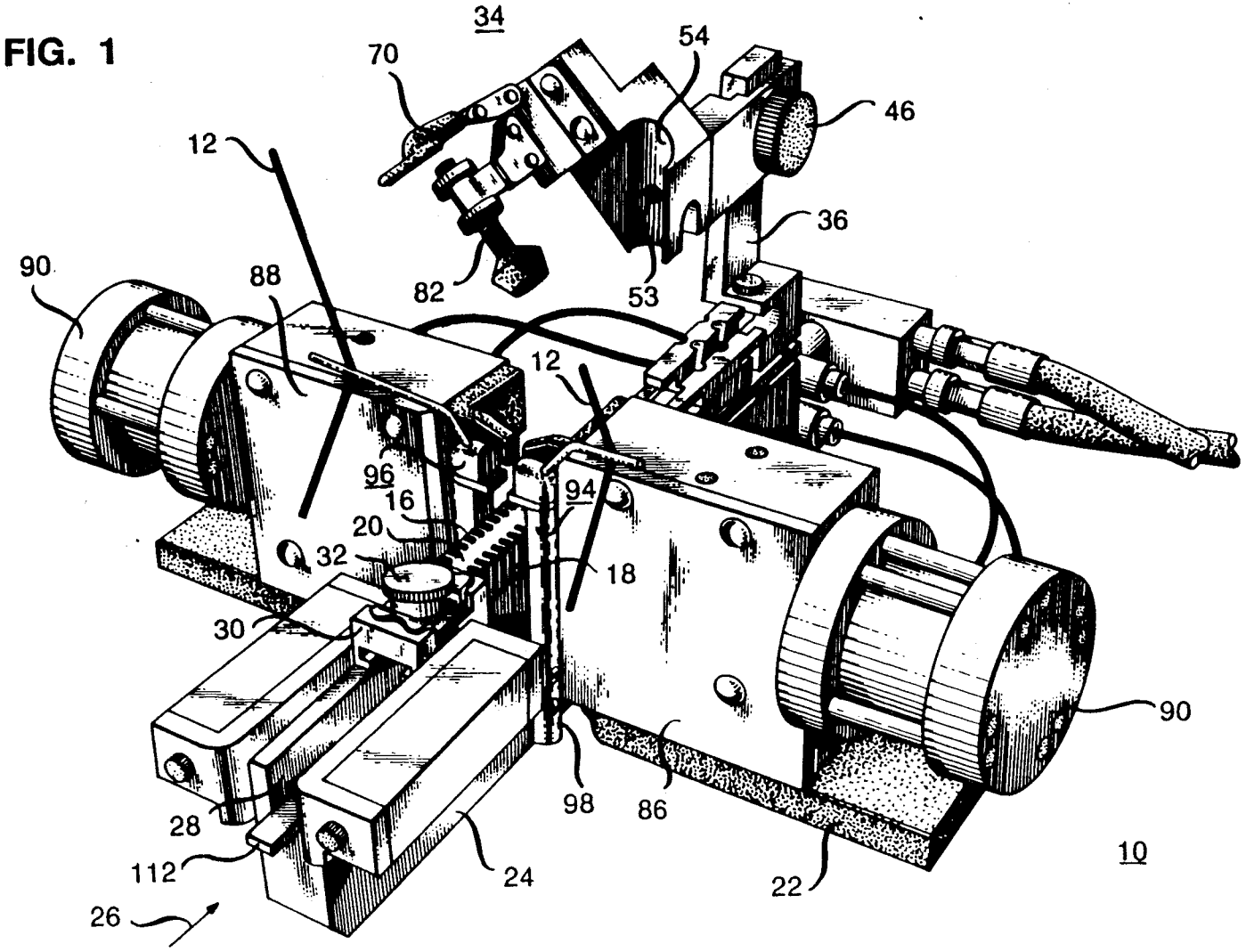
FIG. 1 is perspective view of an apparatus, in accordance with the invention, for attaching each of a successive pair of wires in a cable to each of a successive pair of contacts in a data connector.
Figure 2:
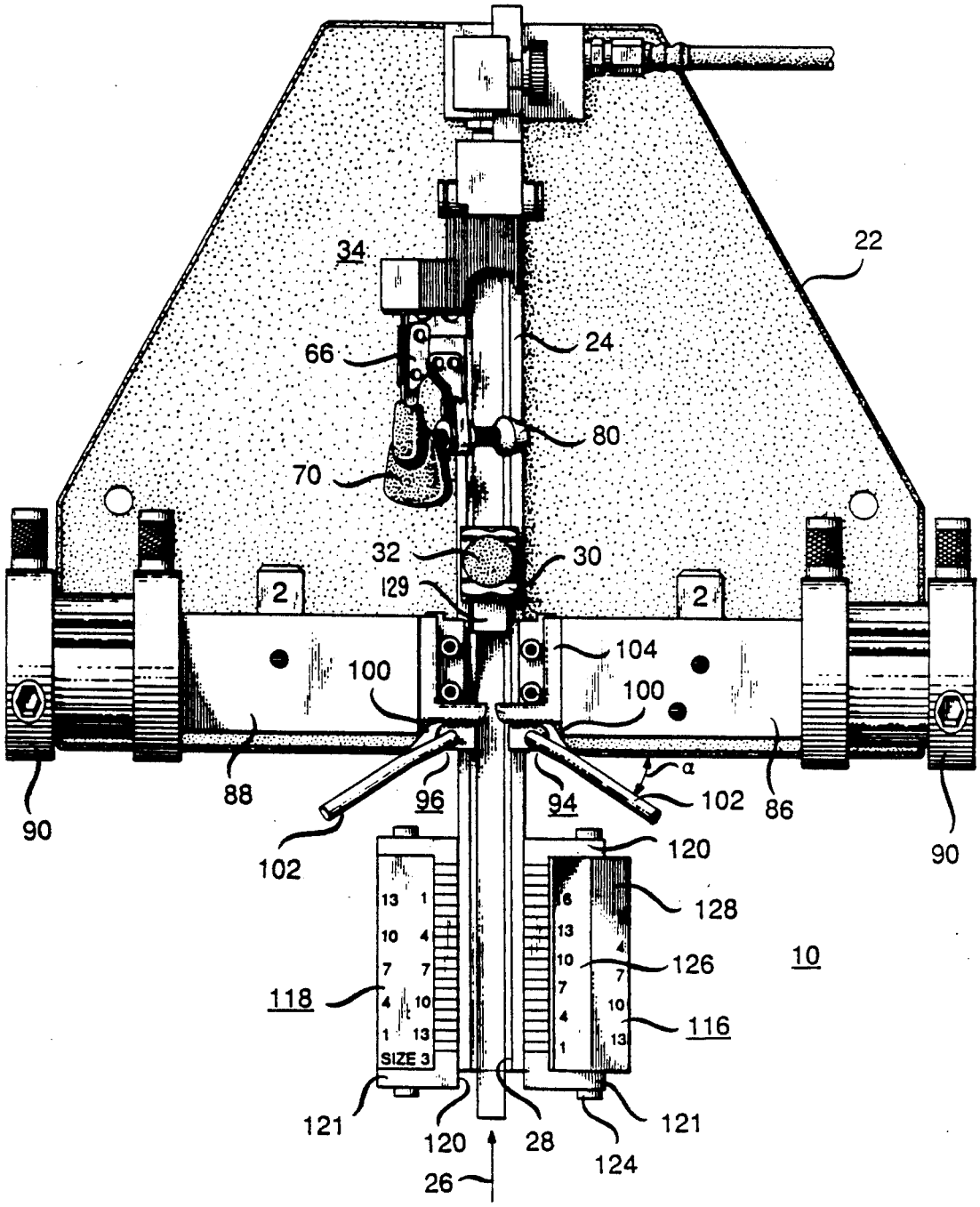
FIG. 2 is a plan view of the apparatus of FIG. 1.
Figure 3:
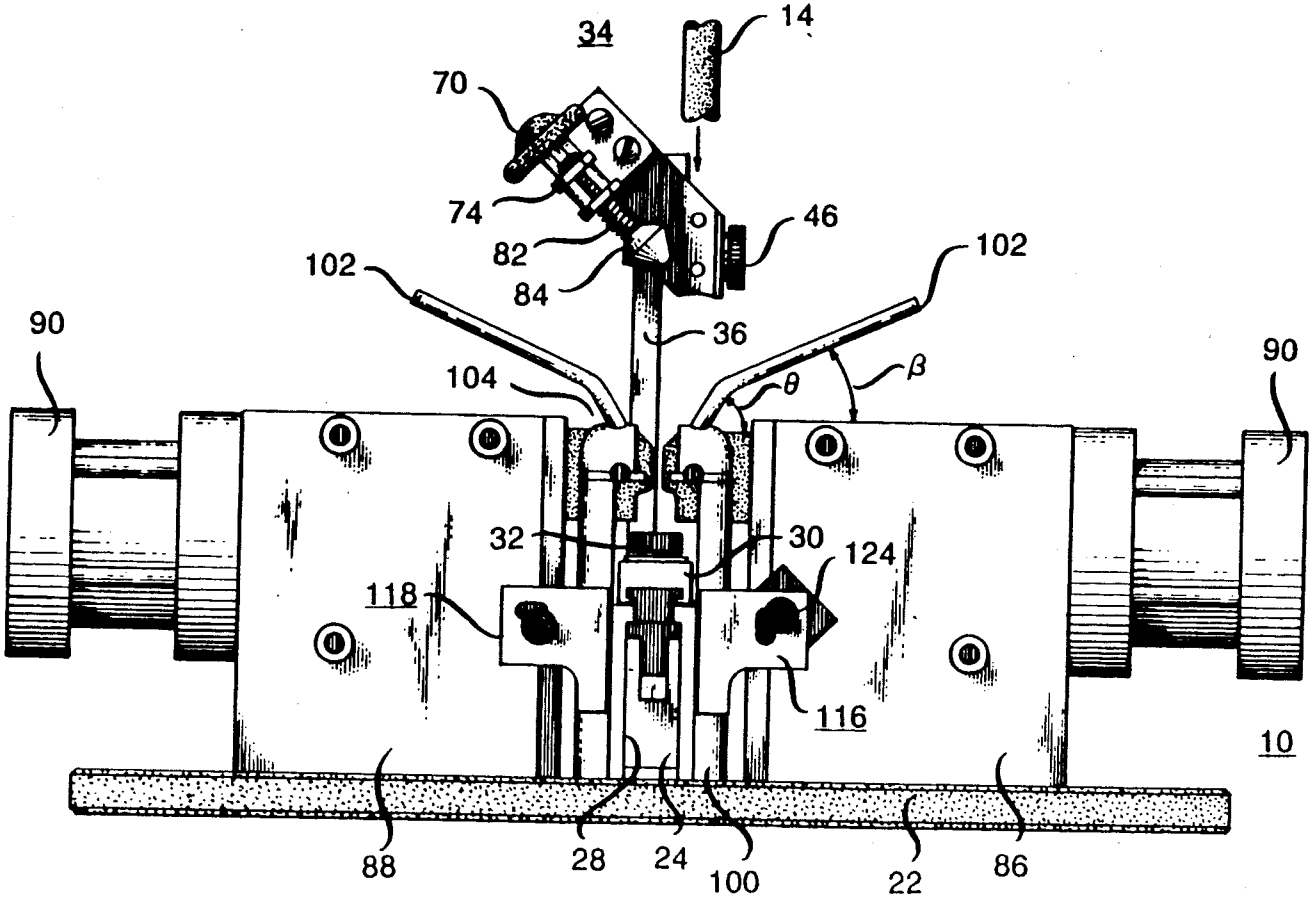
FIG. 3 is a front view of the apparatus of FIG. 1.

FIGS. 1, 2 and 3 are perspective, plan and front views, respectively, of a connector attachment tool 10 in accordance with the invention. As will be described in greater detail below, the tool 10 serves to attach each of a pair of wires 12 (FIG. 1) in a cable 14 (see FIGS. 3, 5 and 6) to each of a pair of contacts 16 seated in opposed recesses 18 in a data connector 20 (all of FIG. 1), typically of the RS-232 type. The tool 10 is similar to the connector attachment tool disclosed in U.S. Pat. No. 4,903,399, issued on Feb. 27, 1990, in the name of K. H. Billingham et al. (incorporated by reference herein) but contains several improvements which render the instant tool well suited for attaching successive pairs of wires 12 to the data connectors 20.

The tool 10 comprises a generally pentagon-shaped base 22, typically made from a metal such as aluminum or the like. Rising upwardly from the base 22 is a wall 24 which runs parallel to an axis 26 (see FIGS. 1 and 2). The wall 24 has a groove or track 28 (see FIG. 1) in its upper surface seated within which is the lower portion of a carriage 30 which is slidably mounted for movement on the wall along the axis 26. The carriage 30 is sized to seat the connector 20 and a screw clamp 32 is threaded into the top of the carriage near its rearward or lower end, as seen in FIG. 2, to releasably secure the connector to the carriage.

Figure 5:
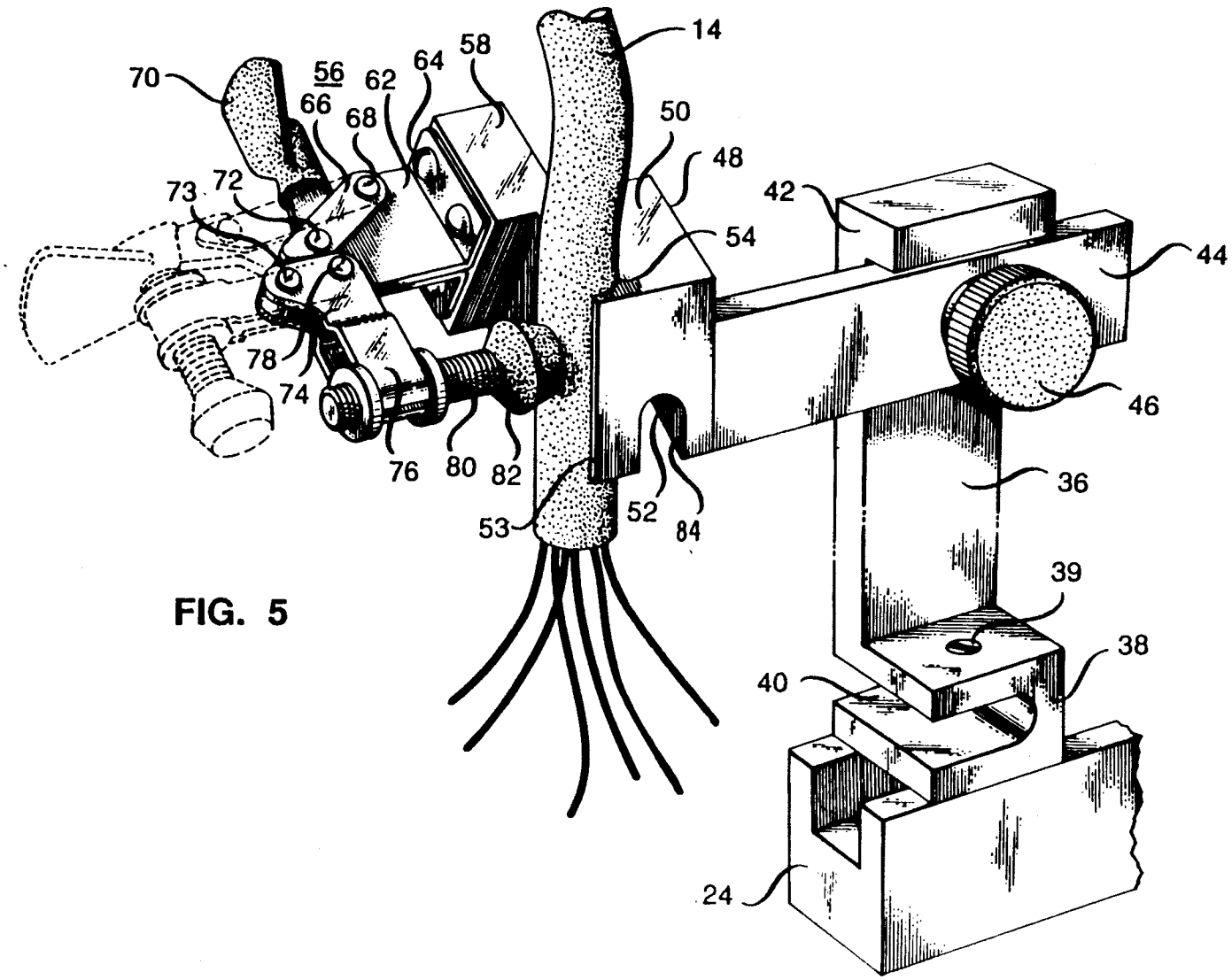
FIG. 5 is an enlarged view of a portion of FIG. 1 showing a cable clamp mounted on the apparatus to hold a cable in a vertical orientation.
Figure 6:
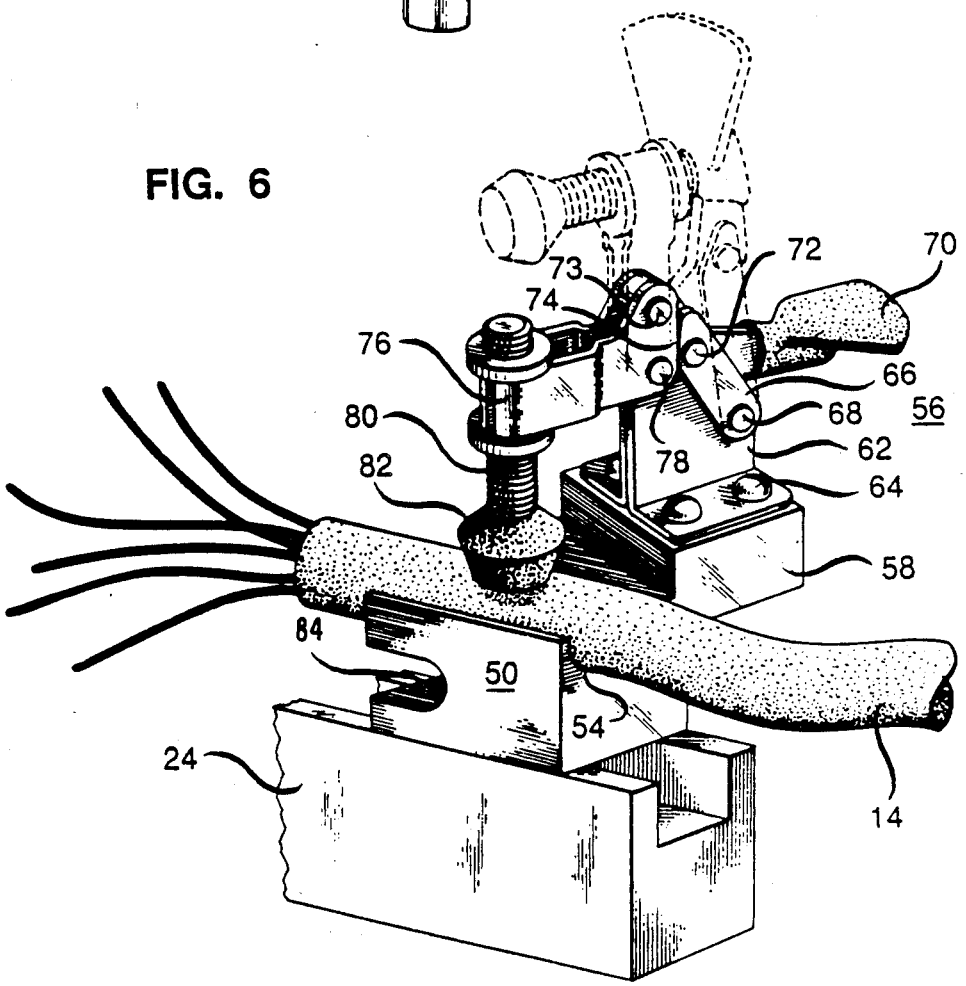
FIG. 6 is shows a portion of the cable clamp of FIG. 5 mounted on the apparatus of FIG. 1 to hold a cable in a horizontal orientation.

Referring now to FIG. 2, a cable clamp assembly 34 is secured to the forward end (upper end, as seen in FIG. 2) of the wall 24 for releasably clamping the cable 14 in either a vertical orientation, as seen in FIG. 5, or horizontal orientation as seen in FIG. 6. Referring to FIG. 5, the cable clamp assembly 34 comprises a column 36 having a flanged base 38 for attachment to the top of the wall 24 by way of a threaded fastener 39. A cutout 40 is provided in the forward end (left-hand end in FIG. 5) of the column base 38 to enable the forward end of the carriage 30 of FIGS. 1 and 2 to partially enter the base.

At the upper end of the column 36 of FIG. 5 is a horizontally protruding lip 42 whose lower surface serves as a stop for the upper edge of a horizontal arm 44 secured to the column 36 by a thumb screw 46. The leftward end of the arm 44 abuts a first, substantially flat face 48 of a block 50 which is attached to the arm by way of a pair of threaded fasteners 52 (only one of which is shown). Opposite the first face 48 on the block 50 is a second parallel face 53 which has a rounded channel 54 therein which serves to receive the cable 14.

The cable 14 is held in the channel 54 in the block 50 by way of a clamp 56 which is attached to a raised lip section 58 integral with, and extending out from, the block at an upwardly inclined angle as seen in FIG. 5. The clamp 56 comprises a wall 62 whose base is flanged for attachment to the lip 58 by way of a set of threaded fasteners 64. A link 66 has a first end pivotally mounted to the wall 62 by way of a pin 68 while the second end of the link is pivotally connected to a lever 70 by way of a pin 72. The lever 70 is also pinned by a pin 73 to the base end 74 of an "L"-shaped member 76, the base end also being pinned to the wall 62 by a pin 78. The member 76 has a shaft 80 threaded into its major portion so as to extend in a perpendicular direction from the member. At the lower tip of the shaft 80 is a rubber tip 82.

Both the lever 70 and link 68 pivot, allowing the lever and link to be pivoted to a first position (as shown in solid lines in FIG. 5) and a second position (shown in phantom). At the first position, the link 66 and the lever 70 are pivoted such that the second end of the link (the end pinned to the lever) abuts the base end 74 of the member 75. While the link 66 abuts the base end 74 of the member 76, the major portion of the member is held parallel to the face 52 of the block 48, so that the shaft 80 is perpendicular to the block face 52 and extends towards the channel 54. By adjusting the extent to which the shaft 80 depends from the member 76, the rubber tip 82 can be made to bear against the cable 14 to clamp the cable in place while the lever 70 and clamp 66 are pivoted to the first position.

When the lever 70 is pivoted leftward in FIG. 5, the lever and the link 66 will be at their second position (as shown in phantom) at which they are aligned with each other. At this position, the link 66 no longer abuts the base end 74 of the member 76, but rather, the member is pivoted clockwise 90° from its previous position so that the tip 82 at the end of the shaft 80 no longer grips the cable.

As thus described, the clamping mechanism 34 clamps the cable 14 in a vertical orientation. However, by unthreading the fasteners 52 and detaching the block 50 from the end of the arm 44, and by attaching the block so that its face 48 sits directly on the wall 24, as shown in FIG. 6 (in place of the column 36 of FIG. 5), the clamp 56 can thus clamp the cable 14 in a horizontal orientation. To clamp the cable 14, the lever 70 and the link 66 are pivoted to their first position as described previously, while the cable is released by pivoting the lever 70 (and the link) to its second position as described previously. Just as the flanged base 38 of the column 36 of FIG. 5 has a cutout 40 to partially receive the forward end of the carriage 34 of FIG. 1, the block 50 also has a similar cutout 84 which likewise serves to partially receive the forward carriage end when the block is mounted to the wall 24 as seen in FIG. 6.

Referring to FIGS. 1, 2 and 3, the tool 10, like the Billingham et al. tool described in U.S. Pat. No. 4,903,399, comprises a pair of ram assemblies 86 and 88, each facing a separate one of the sides of the wall 24 so as to oppose each other. Each of the ram assemblies 86, 88 includes an actuator 90, typically a pneumatic cylinder, which serves to reciprocate a knife blade 92 (see FIG. 4) to and from the connector 20 of FIG. 1. When urged toward the connector 20, the blade 92 of FIG. 4 serves to ram a separate one of a pair of the wires 12 into a separate one of a pair of opposed recesses 18 in alignment with the blade.

To facilitate insertion of the pair of wires 12 into a pair of opposed recesses 18 of FIG. 1 by the ram assemblies 86 and 88, the tool 10 includes a pair of wire guides 94, 96, each serving to align one of the pair of wires with a corresponding ram assembly. Each of the wire guides 94 and 96 comprises a pillar 98 attached to, and rising upwardly from, a separate one of the sides of the wall 24 directly opposite the pillar of the other guide. Each pillar 98 is situated between the wall 24 and a separate one of the ram assemblies 86 and 88 so that the pillar is situated leftward, as seen in FIG. 1, of the bulk of the ram assembly, leaving a small gap 100 (See FIG. 2) between the pillar and the ram assembly large enough for a wire 12 to fit therein. It is through this gap 100 that the knife blade 92 is laterally reciprocated to and from the connector 20 of FIG. 1 for at least partial insertion into, and withdrawal from, a recess 18 aligned with the blade to insert the wire into the recess.

As best seen in FIG. 3, each pillar 98 has a finger 102 which extends upwardly from its upper tip at a first angle $\theta$ relative to the base 22 for a short distance and then a second, slightly smaller angle $\beta$ for the rest of its length, so as to diverge from the finger extending upwardly from the other pillar. The fingers 102 have the appearance of "rabbit ears." As shown FIG. 2, in addition to being upwardly inclined, each finger 102 makes a lateral angle $\gamma$ with respect to the forward face of each corresponding ram assembly 86, 88. Each finger 102 has a smooth exterior surface, and thus provides a substantially friction-free path along which a wire 12 may be pulled by an operator into the gap 100 so as to now be aligned with the blade 92 of FIG. 4.

Referring to FIGS. 1 and 2, each of the wires guides 94, 96 includes an "L"-shaped member 104 which has one of its legs attached to the upper end of the inside face of a separate one of the ram assemblies 86, 88 so that the free leg of each "L"-shaped member 104 extends directly towards, so as to be in alignment with, the free leg of the other "L"-shaped member. When mounted to its associated ram assembly 86, 88, the "L"-shaped member 104 serves to partially close the gap 100 between the pillar 98 and the ram assembly. Thus, each member 104 aids in preventing the wire 12, pulled into alignment with the blade 92 of FIG. 4, from slipping past the blade.

Figure 4:
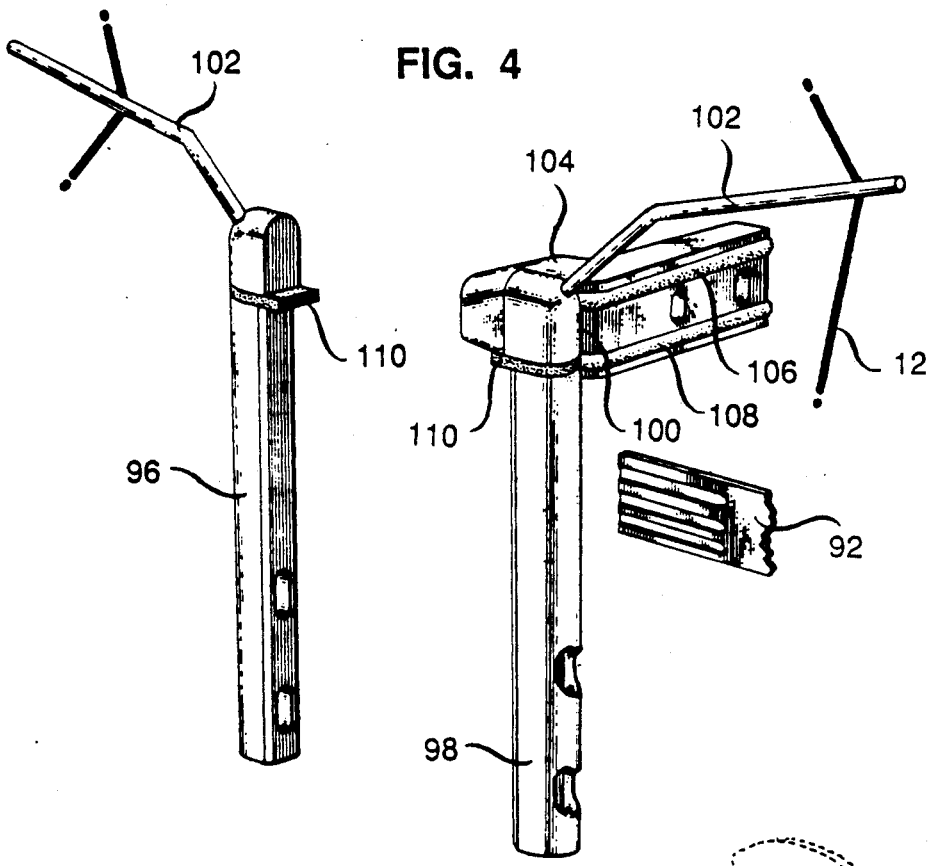
FIG. 4 is an enlarged view of a portion of a wire guide on the apparatus of FIG. 1 showing a wire retainer comprising part of the guide.

Referring now to FIG. 4, each of the "L"-shaped members 104 (only one of which is shown) has a pair of wire retaining springs 106 and 108 which horizontally circumscribe its periphery, one spaced above the other. Each pillar 98 also has a wire retaining spring 110 which horizontally circumscribes the periphery of the pillar so as to be at a height between that of the springs 106 and 108 on the member 104. The wire retaining springs 106 and 108 on the member 104 cooperate with the wire retaining spring 110 on the column to grab a wire pulled into the gap 100 during the process of aligning the wire with the blade 94. By grabbing the wire, the springs 106, 108 and 110 thus relieve the need for an operator to tension the entire length of the wire 12. Rather, with the wire 12 now engaged by the springs 106, 108 and 110, the operator need only tension the end of the wire below the springs, thus reducing the operator effort required to align and hold each pair of wires to be attached to the connector 20.

Referring to FIG. 1, situated within the wall 24 is a mechanism 112 (only a portion of which is shown) which serves to successively advance the carriage 30 rightwardly along the axis 26. The mechanism 112 is identical to the carriage-advancing mechanism described in the aforementioned Billingham et al., patent and is actuated by one of the ram assemblies 86, 88. When actuated, the mechanism 112 serves to advance the carriage to 30 to locate each of a successive pair of opposed recesses 18 in the connector 20 in alignment with the blade 92 of a separate one of the ram assemblies 86, 88. In this way, each of another pair of wires can be attached to each of a successive pair of contacts 16 of FIG. 1.

Usually, the process of attaching successive pairs of the wires 12 to successive pairs of opposed contacts 16 in the connector 20 is carried out in one sitting by the operator. However, it is not unusual for the operator to become interrupted, causing him or her to lose track of which pair of contacts 16 on the connector had just had a pair of wires 12 attached thereto. While indicia (not shown) are usually embossed in the connector block 20 to identify the number of each contact 16, such indicia are usually very difficult to read, and tend to be obscured as the connector block is transported so as to be opposite the ram assemblies 86, 88.

To overcome this difficulty, the tool 10 of FIGS. 1–3 is advantageously provided with a pair of scale assemblies 116 and 118 which each identify the particular one of the contacts 16 in a separate one of the rows of contacts in the connector 20, then in alignment with a separate one of the ram assemblies 86, 88. Each scale assembly 116, 118 comprises an elongated "U"-shaped bracket 120 having its spine attached to an opposed face of the wall 24 so that the two short legs 121 of the bracket extend horizontally outwardly, at the same height and in a direction opposite to, the legs 121 on the other bracket. The bracket 120 of each scale assembly 116, 118 has an opposite one of the ends of a prismatic block 122 journaled thereto by way of a removable pin 124 so that each block may rotate about an axis parallel to the axis 26 of FIG. 1.

As best seen in FIG. 2, the block 122 associated with each scale assembly 116, 118 has indicia in the form of a scale 126 inscribed or imprinted on at least one of its four sides 128. The scale 126 on each side 128 of the block 122 is arranged so that each individual graduation corresponds to the number of a separate one of the contacts 16 in a particular type of connector block 20 of FIG. 1. The numbering and spacing between the contacts 16 varies with different types of connector blocks 20 and thus to accommodate as many as four separate types of connector blocks, each of the sides 128 carries a different scale 126. The block 122 of each scale assembly can be replaced by removing the pins 124 holding the block to the bracket so that another block, having different scales thereon, can be substituted. Obviously, the scales 126 carried by the block 122 of the scale assembly 116 must be identical to those carried by the block of the scale assembly 118.

Referring to FIG. 2, the carriage 30 has a mark 129 inscribed in its upper surface rearward (downward in FIG. 2) from the clamping screw 32. The mark 129 serves to indicate the particular graduation of the scale 126 on each block 122 corresponding to the number of the contact 16 in the connector block 20 (both of FIG. 1) then aligned with a separate one of the ram assemblies 86, 88. As the carriage 30 is advanced forwardly (upwardly in FIG. 1), the mark 129 also moves forwardly along each scale 126 to indicate the particular connector block contact 16 now in alignment with the corresponding one of the ram assemblies 116, 118.

The foregoing describes a connector attachment tool which includes tool 10 for attaching successive pairs of wires 12 in a cable 14 to successive pairs of opposed contacts 16 in a data connector 20. The instant tool 10 advantageously includes: (1) a clamp assembly 34 for clamping the cable 14 horizontally or vertically, (2) a pair of scale assemblies 116, 118 for identifying the contact 16 to which such wires 12 are attached, and (3) and wire retainers 102, 104 and 106 for grabbing each wire during attachment.

It is to be understood that the above-described embodiments are merely illustrative of the principles of the invention. Various modifications and changes may be made thereto by those skilled in the art which will embody the principles of the invention and fall within the spirit and scope thereof.

I claim:

1. Apparatus for attaching each of a pair of wires in a cable to each of a pair of contacts seated in a separate one of a pair of opposed recesses in a data connector, comprising:

a base;

a wall rising upwardly from the base and running along a first axis;

a carriage slidably mounted for movement on the wall along the first axis, the carriage adapted to carry a connector having two rows of opposed contacts, each seated in a recess, such that the rows of contacts are each parallel to the first axis;

cable clamp means adapted for detachable mounting to the wall in a separate one of two positions for clamping a multi-wire cable in horizontal and vertical orientations, respectively;

a pair of ram assemblies, each located on opposite sides of the wall, for ramming a separate one of a pair of wires in the cable against a separate one of a pair of opposed contacts in the connector;

a pair of wire guides, each secured to the wall adjacent to a separate one of the ram assemblies for aligning a separate one of the wires in the cable, when the wire is pulled along the wire guide by an operator, with a separate one of the ram assemblies;

wire-retaining means associated with each wire guide for releasably grabbing the wire pulled along the wire guide; and means for displacing the carriage in a first direction along the first axis such that each of a successive pair of opposed contacts is aligned with a separate one of the ram assemblies.

2. The apparatus according to claim 1 further including a pair of scales, each mounted to a separate one of the sides of the wall upstream of a corresponding one of the wire guides for providing a visual indication of which contact in a separate one of the rows of contacts in the connector is aligned with a separate one of the ram assemblies as the carriage is displaced along the first axis.

3. The apparatus according to claim 2 wherein each scale comprises:

a prismatic block having four longitudinal sides, at least one side having graduations thereon spaced the same as the contacts in each row in the connector; and a bracket secured to one of the sides of the wall for rotatably journalling each of the ends of the block to allow the block to rotate about an axis parallel to the first axis such that a longitudinal face of the block having graduations thereon can be aligned parallel to the upper surface of the wall.

4. The apparatus according to claim 1 wherein the cable clamp means includes:

a block having first and second opposed parallel surfaces, the first surface having a longitudinal, half-rounded channel therein sized to seat the multi-wire cable, and the second surface adapted for attachment on the upper surface of the wall downstream of the forward end of travel of the carriage such that the channel is parallel to the first axis when the cable is to be clamped in a horizontal orientation; and a clamp carried by the block for releasably urging the cable into the channel.

5. The apparatus according to claim 4 wherein the cable clamp further includes:

a vertical column having a flanged base adapted for attachment to the upper surface of the wall downstream of the forward end of travel of the carriage when the cable is to be clamped in a vertical orientation;

an arm attached to the column and extending horizontally therefrom parallel to the first axis, said arm having a free end distant from the column adapted for attachment to the second surface of the block so that when the block is attached to the arm, the channel in the first surface of the block runs vertically to seat the wire in a vertical orientation.

6. The apparatus according to claim 1 wherein each wire guide comprises:

an upwardly extending pillar attached to an opposed one of the sides of the wall adjacent to a separate one of the ram assemblies such that a small gap exists between the pillar and the ram assembly;

a member extending upwardly from the upper end of the pillar at a first angle (relative to the base) for a first distance and then extending at a second angle thereafter, said member having a smooth exterior surface along which a wire may be pulled by an operator into the gap between the pillar and the ram assembly;

an "L"-shaped member having a first leg attached to to the end of the ram assembly facing the wall so as to be at a height thereabove, and having a second leg extending horizontally from the ram assembly towards the second leg on the "L"-shaped member of the other wire guide, the second leg of the member serving to close a portion of the upper end of the gap between the pillar and the ram assembly.

7. The apparatus according to claim 6 wherein the wire-retainer means associated with each wire guide comprises:

first and second wire-retaining springs which each horizontally circumscribe the "L"-shaped member of the wire guide at a separate one of a first and second height, respectively; and a third wire-retaining spring which horizontally circumscribes the upper end of the pillar at a height between the first and second heights so as to lie between the first and second wire-retaining springs, respectively.

8. Apparatus for attaching each of a pair of wires in a cable to each of a pair of contacts seated in a separate one of a pair of opposed contacts in a data connector comprising:

a base;

a wall rising upwardly from the base and running along a first axis;

a carriage slidably mounted for movement on the wall along the first axis, the carriage adapted to carry a connector having two rows of opposed contacts such that the rows of contacts are each parallel to the first axis;

cable clamp means adapted for detachable mounting to the wall in a separate one of two positions for clamping a multi-wire cable in horizontal and vertical orientations, respectively;

a pair of ram assemblies, each located on opposite sides of the wall for ramming a separate one of a pair of wires in the cable into a separate one of a pair of opposed contacts in the connector;

a pair of wire guides, each secured to the wall adjacent to a separate one of the ram assemblies for aligning a separate one of the wires in the cable, when the wire is pulled along the wire guide by an operator, with a separate one of the ram assemblies;

wire-retaining means associated with each wire guide for releasably grabbing the wire pulled across the wire guide; and means for displacing the carriage in a first direction along the first axis such that each of a successive pair of opposed contacts is aligned with a separate one of the ram assemblies; and a pair of scales, each mounted to a separate one of the sides of the wall upstream of a corresponding one of the wire guides for providing a visual indication of which contact in a separate one of the rows of contacts in the connector is aligned with a separate one of the ram assemblies.

9. The apparatus according to claim 8 wherein each scale comprises:

a prismatic block having four longitudinal sides, at least one side having graduations thereon spaced the same as the contacts in each row in the connector; and a bracket secured to the side of the wall for rotatably journalling each of the ends of the block to allow the block to rotate about an axis parallel to the first axis such that a longitudinal face of the block having graduations thereon can be aligned parallel to the upper surface of the wall.

10. The apparatus according to claim 8 wherein the cable clamp means includes:

a block having first and second opposed parallel surfaces, the first surface having a longitudinal, half-rounded channel therein sized to seat the multiwire cable, and the second surface adapted for attachment on the upper surface of the wall downstream of the forward end of travel of the carriage such that the channel is parallel to the first axis when the cable is to be clamped in a horizontal orientation; and a clamp carried by the block for releasably urging the cable into the channel.

11. The apparatus according to claim 10 wherein the cable clamp further includes:

a vertical column having a flanged base adapted for attachment to the upper surface of the wall downstream of the forward end of travel of the carriage when the cable is to be clamped in a vertical orientation;

an arm attached to the column and extending horizontally therefrom parallel to the first axis, said arm having a free end distant from the column adapted for attachment to the second surface of the block so that when the block is attached to the arm, the channel in the first surface of the block runs vertically to seat in the wire in a vertical orientation.

12. The apparatus according to claim 8 wherein each wire guide comprises:

an upwardly extending pillar attached to an opposed one of the sides of the wall adjacent to a separate one of the ram assemblies such that a small gap exists between the pillar and the ram assembly;

a member extending upwardly from the upper end of the pillar at a first angle (relative to the base) for a first distance and then extending at a second angle thereafter, said member having a smooth exterior surface along which a wire may be pulled by an operator and into the gap between the pillar and the ram assembly;

an "L"-shaped member having a first leg attached to the end of the ram assembly facing the wall so as to be at a height thereabove, and having a second leg extending horizontally from the ram assembly towards the second leg on the "L"-shaped member of the other wire guide, the second leg of the member serving to close a portion of the upper end of the gap between the pillar and the ram assembly.

13. The apparatus according to claim 12 wherein the wire-retainer means associated with each wire guide comprises:

first and second wire-retaining springs which each horizontally circumscribe the "L"-shaped member of the wire guide at a separate one of the first and second heights, respectively; and a third wire-retaining spring which horizontally circumscribes the upper end of the pillar at a height between the first and second heights so as to lie between the first and second wire-retaining springs, respectively.

* * * * *